US009660354B2

(12) United States Patent
Kamoshida et al.

(10) Patent No.: US 9,660,354 B2
(45) Date of Patent: May 23, 2017

(54) ALUMINUM ELECTRIC WIRE CONNECTING STRUCTURE

(71) Applicant: NISSHIN STEEL CO., LTD., Tokyo (JP)

(72) Inventors: Shinichi Kamoshida, Osaka (JP); Tadaaki Miono, Osaka (JP); Yasunori Hattori, Osaka (JP); Takeshi Shimizu, Osaka (JP); Mitsuru Suzuki, Osaka (JP)

(73) Assignee: NISSHIN STEEL CO., LTD., Tokyo (JP)

( * ) Notice: Subject to any disclaimer, the term of this patent is extended or adjusted under 35 U.S.C. 154(b) by 0 days.

(21) Appl. No.: 14/909,714

(22) PCT Filed: Jul. 23, 2014

(86) PCT No.: PCT/JP2014/069449
§ 371 (c)(1),
(2) Date: Feb. 2, 2016

(87) PCT Pub. No.: WO2015/019850
PCT Pub. Date: Feb. 12, 2015

(65) Prior Publication Data

US 2016/0190711 A1 Jun. 30, 2016

(30) Foreign Application Priority Data

Aug. 6, 2013 (JP) ..... 2013-163170

(51) Int. Cl.
*H01R 4/10* (2006.01)
*H01R 4/18* (2006.01)
*H01R 4/62* (2006.01)

(52) U.S. Cl.
CPC ..... *H01R 4/188* (2013.01); *H01R 4/184* (2013.01); *H01R 4/62* (2013.01)

(58) Field of Classification Search
CPC ..... H01R 4/185; H01R 4/188; H01R 43/048; H01R 9/0518
(Continued)

(56) References Cited

U.S. PATENT DOCUMENTS 3,052,750 A 9/1962 Cobaugh
4,142,771 A 3/1979 Barnes et al.
(Continued)

FOREIGN PATENT DOCUMENTS

EP 2 555 328 A1 2/2013
JP 3-121661 U 12/1991
(Continued)

OTHER PUBLICATIONS

Search Report and Written Opinion mailed Jul. 21, 2016 in corresponding Singapore Patent Application No. 11201600675T (9 pages).
(Continued)

*Primary Examiner* — Hae Moon Hyeon
(74) *Attorney, Agent, or Firm* — Rothwell, Figg, Ernst & Manbeck, P.C.

(57) ABSTRACT

A connector includes a crimping portion (12) provided at an inner surface with projections (13) having inclined sides (19), the crimping portion (12) being provided with a combination of a base portion (14) and first and a second protruding portions (15) and (16) protruding from the base portion (14), the first protruding portion (15) having a distal end part (15*a*) located at an inside of a distal end part (16*a*) of the second protruding portion (16), the crimping portion (12) having a ring-shaped section perpendicular to a length direction of the aluminum electric wire (21), the projections (13) being projected into surface areas of the aluminum
(Continued)

electric wire (21), with distorted regions formed along the inclined sides (19) in a surface part of the aluminum electric wire (21).

2 Claims, 12 Drawing Sheets

(58) Field of Classification Search
USPC ..... 439/877, 585
See application file for complete search history.

(56) References Cited

U.S. PATENT DOCUMENTS

| | | | | |
|---|---|---|---|---|
| 5,396,033 | A * | 3/1995 | Piriz | H01R 4/186 174/71 R |
| 5,519,170 | A * | 5/1996 | Nabeshima | H01R 13/5205 174/74 R |
| 5,554,826 | A * | 9/1996 | Gentry | H01B 5/104 174/128.1 |
| 6,206,727 | B1 * | 3/2001 | Aoyama | H01R 9/0518 439/424 |
| 6,517,392 | B2 * | 2/2003 | Murakami | H01R 43/048 439/877 |
| 6,559,385 | B1 * | 5/2003 | Johnson | H01B 5/105 174/126.1 |
| 7,228,627 | B1 | 6/2007 | Yoshimura et al. | |
| 7,828,612 | B2 * | 11/2010 | Kumakura | H01R 4/185 439/877 |
| 7,867,027 | B2 * | 1/2011 | Sakaguchi | H01R 4/184 439/585 |
| 8,882,549 | B2 * | 11/2014 | Suzuki | H01R 4/188 439/882 |
| 2001/0016460 | A1 | 8/2001 | Koide | |
| 2012/0295496 | A1 * | 11/2012 | Suzuki | H01R 4/188 439/882 |
| 2013/0115830 | A1 | 5/2013 | Seifert et al. | |
| 2016/0172769 | A1 * | 6/2016 | Kamoshida | H01R 4/62 439/877 |

FOREIGN PATENT DOCUMENTS

| | | | |
|---|---|---|---|
| JP | 6-52734 | A | 2/1994 |
| JP | 8-69716 | A | 3/1996 |
| JP | 2001-185251 | A | 7/2001 |
| JP | 2011-187400 | A | 9/2011 |
| WO | 2011/125626 | A1 | 10/2011 |

OTHER PUBLICATIONS

Patent Examination Report No. 1 mailed Sep. 23, 2016 in corresponding Australian Patent Application No. 2014303662 (3 pages).
Notification of Reasons for Refusal mailed Nov. 15, 2016 in corresponding Canadian Patent Application No. 2,919,617 (4 pages).
Notice of Allowance mailed Dec. 20, 2016 in corresponding Japanese Patent Application No. 2013-163170 (1 page).
The extended European search report mailed Dec. 22, 2016 in corresponding European Patent Application No. 14834326.2 (8 pages).
International Search Report mailed Aug. 19, 2014 in PCT/JP2014/069449.

* cited by examiner

ALUMINUM ELECTRIC WIRE CONNECTING STRUCTURE

CROSS REFERENCE TO RELATED APPLICATION

This application is a 35 U.S.C. 371 National Phase Entry Application from PCT/JP2014/069449, filed Jul. 23, 2014, which claims priority to Japanese Patent Application No. 2013-163170, filed Aug. 6, 2013, the disclosures of which are incorporated herein in their entirety by reference.

TECHNICAL FIELD

This invention relates to an aluminum electric wire connecting structure including an aluminum electric wire connected to a connector, and specifically, to an aluminum electric wire connecting structure including an aluminum electric wire connected to a connector provided with projections having inclined sides at an inner surface of a crimping portion.

BACKGROUND TECHNIQUES

There will be described an aluminum electric wire connecting structure disclosed in a patent literature 1, by using FIGS. 12 to 16. As shown in the figures, there is a connector 2 having a connecting portion 3 and a crimping portion 4, the connecting portion 3 being integral with the crimping portion 4. The connecting portion 3 as well as the crimping portion 4 is made of copper. The connecting portion 3 is connected to a terminal of a device, for instance. The crimping portion 4 is provided with projections 5 at an inner surface thereof. The projections 5 are formed in a shape of a quadrangular pyramid having a tip part thereof cut off substantially in parallel to a bottom side, so the projections 5 have a combination of four inclined sides 6 triangular in shape. The inclined sides 6 have an inclination angle θ within a range of 45 to 75 degrees relative to areas of surface 8 on the crimping portion 4 each surrounded by a set of four projections 5. At the connector 2, the crimping portion 4 is crimped on a terminal portion of a solid aluminum electric wire 1. As shown in FIG. 16, the crimping portion 4 is formed in a substantially elliptical shape.

This aluminum electric wire connecting structure has sets of projections 5 provided at the crimping portion 4 and pressed into areas of surface of the aluminum electric wire 1, so as shown in FIG. 17, the aluminum electric wire 1 has distorted regions 7 formed as illustrated by two-dot chain lines in surface regions thereof. Further, as will be seen from FIG. 14, at each area of surface 8, four surrounding projections 5 each have inclined sides 6 thereof each opposing another inclined side 6. For this reason, as shown in FIG. 17, distorted regions 7 each have a combination of a local region 7*a* thereof extending along an inclined side 6*a* in opposition to a local region 7*a* thereof extending along an inclined side 6*a*. Accordingly, at each distorted region 7, there can be cold flows developed from local regions 7*a* thereof and stopped by other local regions 7*a* thereof, thus allowing for an ensured stopping of cold flow. As a result, at each distorted region 7, stresses to be relaxed by cold flows can be suppressed, affording to suppress deteriorations in crimp strength (or adhesive force) between the aluminum electric wire 1 and inclined sides 6 of projections 5. Therefore, between the aluminum electric wire 1 and the crimping portion 4, electric resistances to be increased can be suppressed.

LIST OF REFERENCES

Patent Literatures

Patent literature 1: JP 2011-187400 A

SUMMARY OF INVENTION

Problems to be Solved by the Invention

However, such the aluminum electric wire connecting structure has, as shown in FIG. 16, a combination of upper and lower parts in which projections 5 have large intrusions into areas of surface of the aluminum electric wire 1, and a combination of parts to be right and left in FIG. 16, in which projections 5 have small intrusions into areas of surface of the aluminum electric wire 1. Hence, those parts to be right and left in FIG. 16 include distorted regions 7 along inclined sides 6, which are small in thickness, and unable to effectively suppress deteriorations of stress to be caused in distorted regions 7 by cold flows. Therefore, the right and left parts in FIG. 16 have deteriorated adhesive forces between the aluminum electric wire 1 and inclined sides 6 of projections 5, thus failing to effectively suppress electric resistances to be increased between the aluminum electric wire 1 and the crimping portion 4.

Further, the aluminum electric wire 1 and the crimping portion 4 have a connecting portion in between. When this portion undergoes heat produced by current conduction or such, the crimping portion 4 expands by thermal expansion, bringing a combination of one most distal end part and the other most distal end part of the crimping portion 4 shown at the central upper part in FIG. 16, into a mutual pushing condition. Therefore, the crimping portion 4 is deformed to have both most distal end parts move upwards in FIG. 16. In this situation, at the crimping portion 4, those projections 5 provided at distal end parts 4*a* and 4*b* thereof have reduced intrusions into areas of surface of the aluminum electric wire 1. Till then, at states involving projections 5 projected into areas of surface of the aluminum electric wire 1, the aluminum electric wire 1 has been elastically deformed at internal regions thereof, excepting local regions thereof near inclined sides 6, where it has been plastically deformed. For this reason, when brought into a state involving projections 5 projected into areas of surface of the aluminum electric wire 1, with reduced intrusions, those distorted regions 7 residing along inclined sides 6 have reduced thicknesses, while the aluminum electric wire 1 is held in a state having areas of surface thereof contacted on inclined sides 6. As a result, it is disabled to effectively suppress deteriorations of stress to be caused in distorted regions 7 by cold flows. It therefore is unable to have a retained state suppressing electric resistances to be increased between the aluminum electric wire 1 and the crimping portion 4.

This invention has been made to solve the problems described, and it is an object thereof to provide an aluminum electric wire connecting structure adapted to have a retained state suppressing electric resistances to be increased between an aluminum electric wire and a crimping portion of a connector.

Solutions to the Problems

According to a first aspect of this invention, there is provided an aluminum electric wire connecting structure including an aluminum electric wire connected to a connector, wherein the connector includes a crimping portion provided at an inner surface thereof with projections having inclined sides, the crimping portion is provided with a combination of a base portion and a first and a second protruding portion protruding from the base portion, the first protruding portion has a distal end part thereof located at an inside of a distal end part of the second protruding portion, the crimping portion has a ring-shaped section thereof perpendicular to a length direction of the aluminum electric wire, and the projections are projected into surface areas of the aluminum electric wire, with distorted regions formed along the inclined sides in a surface part of the aluminum electric wire.

According to a second aspect of this invention, the aluminum electric wire may well be an aluminum strand wire including aluminum element wires wound around a steel wire having an aluminum film formed on a surface thereof.

Effects of the Invention

According to the first aspect, since the crimping portion has a ring-shaped section thereof perpendicular to a length direction of the aluminum electric wire, the projections can be projected into surface areas of the aluminum electric wire, with even intrusions over an entire circumference of the aluminum electric wire. Therefore, it can suppress electric resistances to be increased between the aluminum electric wire and the crimping portion of the connector. Further, since the first protruding portion has the distal end part located at an inside of the distal end part of the second protruding portion, there can be a combination of a most distal end part of the first protruding portion and a most distal end part of the second protruding portion, kept from being brought into a mutual pushing condition, even when heat is produced by current conduction or such at connecting portion between the aluminum electric wire and the crimping portion. Therefore, those projections provided at the distal end parts of the first and the second protruding portion are kept from having reduced intrusions into areas of surface of the aluminum electric wire. Accordingly, it is allowed to have a retained condition suppressing electric resistances to be increased between the aluminum electric wire and the crimping portion of the connector.

Further, according to the second aspect, since the crimping portion has a ring-shaped section thereof perpendicular to a length direction of the steel wire, the steel wire can be centrally located, when crimping. Hence, it can have even stresses acting on the aluminum element wires, when crimping, thus allowing for a retained arrangement of aluminum element wires free from getting out of shape. Accordingly, the aluminum element wires can be deformed without different variations in extent, so they can be free from breakage when crimping.

MODES OF EMBODIMENTS FOR CARRYING OUT THE INVENTION

Figure 1:
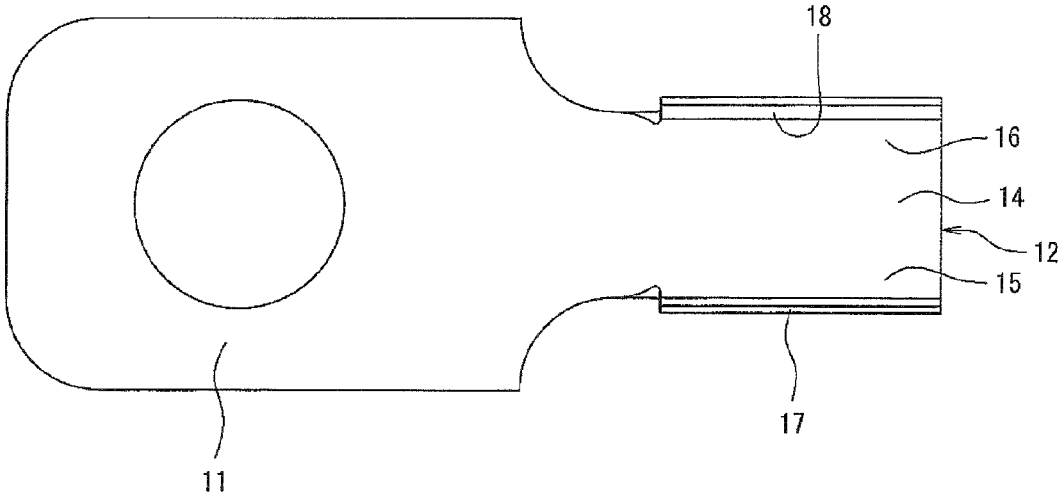
FIG. 1 is a schematic plan view of a connector employed for an aluminum electric wire connecting structure according to an embodiment of this invention.
Figure 2:
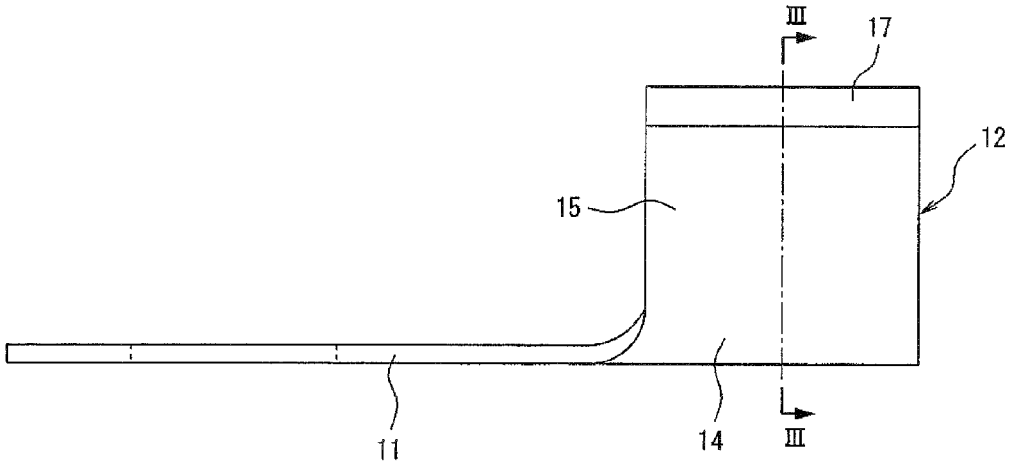
FIG. 2 is a schematic front view of the connector shown in FIG. 1.
Figure 3:
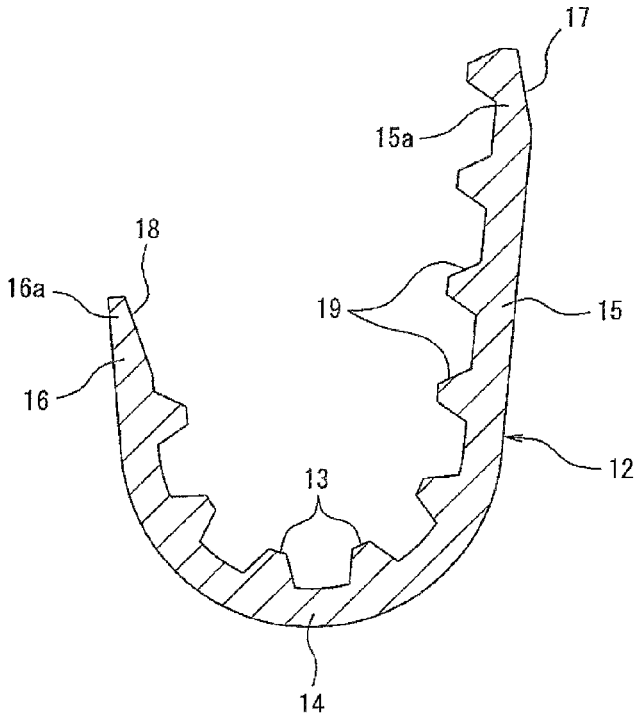
FIG. 3 is an enlarged III-III section of FIG. 2.
Figure 15:
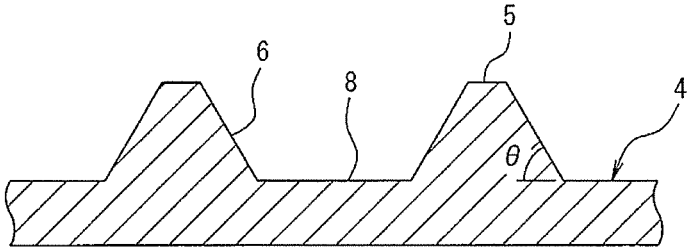
FIG. 15 Prior Art
FIG. 15 is a XV-XV section of FIG. 14.

There will be described a connector employed in an aluminum electric wire connecting structure according to an embodiment of this invention, by using FIG. 1 to FIG. 3. As shown in FIG. 1 and FIG. 2, the connector has a connecting portion 11 and a crimping portion 12, the connecting portion 11 being integral with the crimping portion 12. The connecting portion 11 as well as the crimping portion 12 is made of copper. As shown in FIG. 3, the crimping portion 12 is bent in a U shape. The crimping portion 12 is provided at an inner surface thereof with projections 13 similar to the projections 5 shown in FIG. 15. That is, the projections 13 are formed like a shape of a quadrangular pyramid having a tip part thereof cut off substantially in parallel to a bottom side, so the projections 13 have a combination of four inclined sides 19 substantially triangular in shape. The inclined sides 19 have inclination angles within a range of 45 to 75 degrees. Further, there is a combination of a first and a second protruding portion 15 and 16 protruding from a base portion 14 of the crimping portion 12 continued to the connecting portion 11, the crimping portion 12 thus having the base portion 14, and the first and the second protruding portion 15 and 16. The first protruding portion 15 is longer than the second protruding portion 16. The first protruding portion 15 has a tilt face 17 disposed at an outside (at the right-hand side in FIG. 3) of a distal end part 15*a* thereof. The second protruding portion 16 has a tilt face 18 disposed at an inside (at the right-hand side in FIG. 3) of a distal end part 16*a* thereof. The tilt face 17 and the tilt face 18 are to be brought into contact with each other, when the connector is crimped on an aluminum electric wire.

Figure 4:
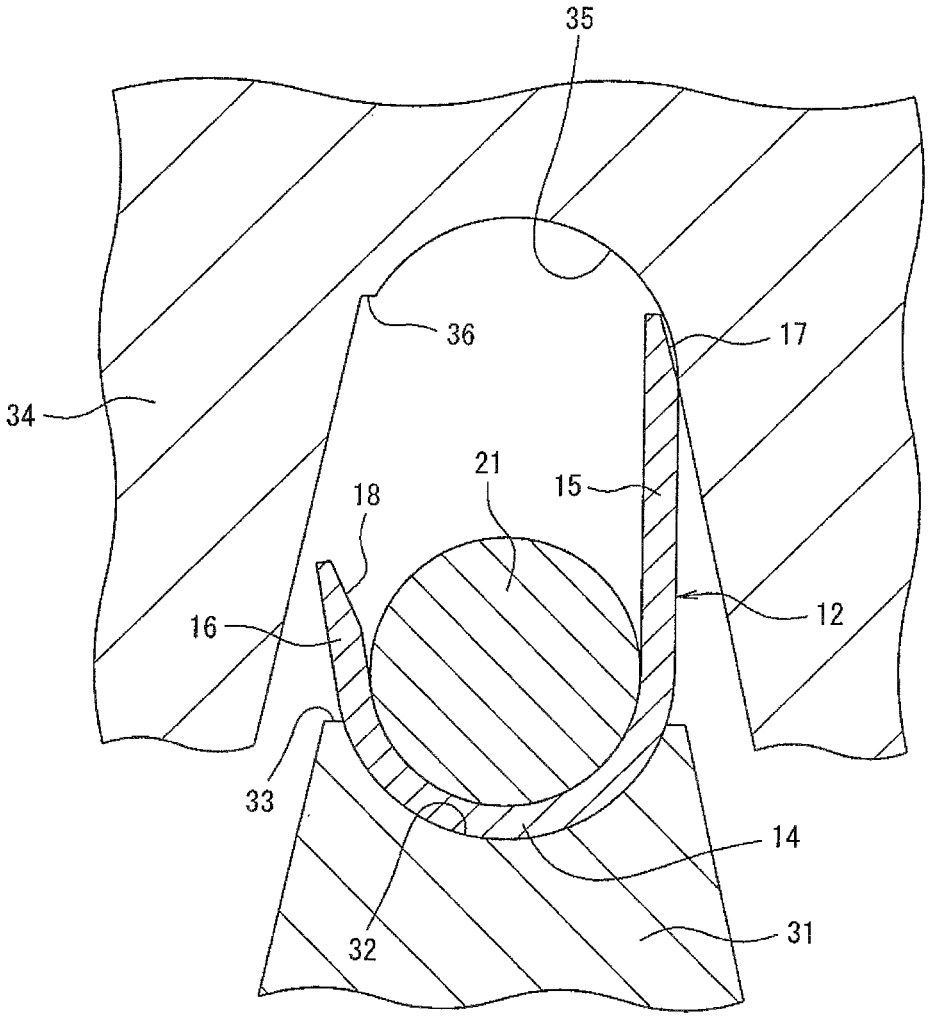
FIG. 4 is a sectional view illustrating a process for connecting an aluminum electric wire to the connector shown in FIG. 1 and FIG. 2.

The connector shown in FIG. 1 and FIG. 2 is used for connection of an aluminum electric wire to be performed by employing a crimping machine that includes, as shown in FIG. 4, a combination of an anvil 31 and a crimper 34. The anvil 31 is formed, as shown in FIG. 4, in a shape diverged downward. As shown in FIG. 4, the anvil 31 has a recess 32 provided at a top end of an upper portion thereof. Further, as shown in FIG. 4, the anvil 31 has a receiving part 33 disposed at a left part of the upper portion thereof. As shown in FIG. 4, the crimper 34 is provided at a lower portion thereof with a recess 35 diverged downward in FIG. 4. Further, the crimper 34 has a pressing part 36 disposed at a part of the recess 35 corresponding to the receiving part 33. And, in a state shown in FIG. 8, that is, in a state involving the connector connected at the crimping portion 12 to an aluminum electric wire 21, the recess 32 cooperates with the recess 35 to define a cylindrical space extending in a length direction of the aluminum electric wire 21. Further, in the state shown in FIG. 8, the recess 35 of the crimper 34 is brought into contact at an inside 35*a* thereof with lateral sides of the anvil 31. Further, in the state shown in FIG. 8, the second protruding portion 16 is held between the pressing part 36 and the receiving part 33.

Figure 5:
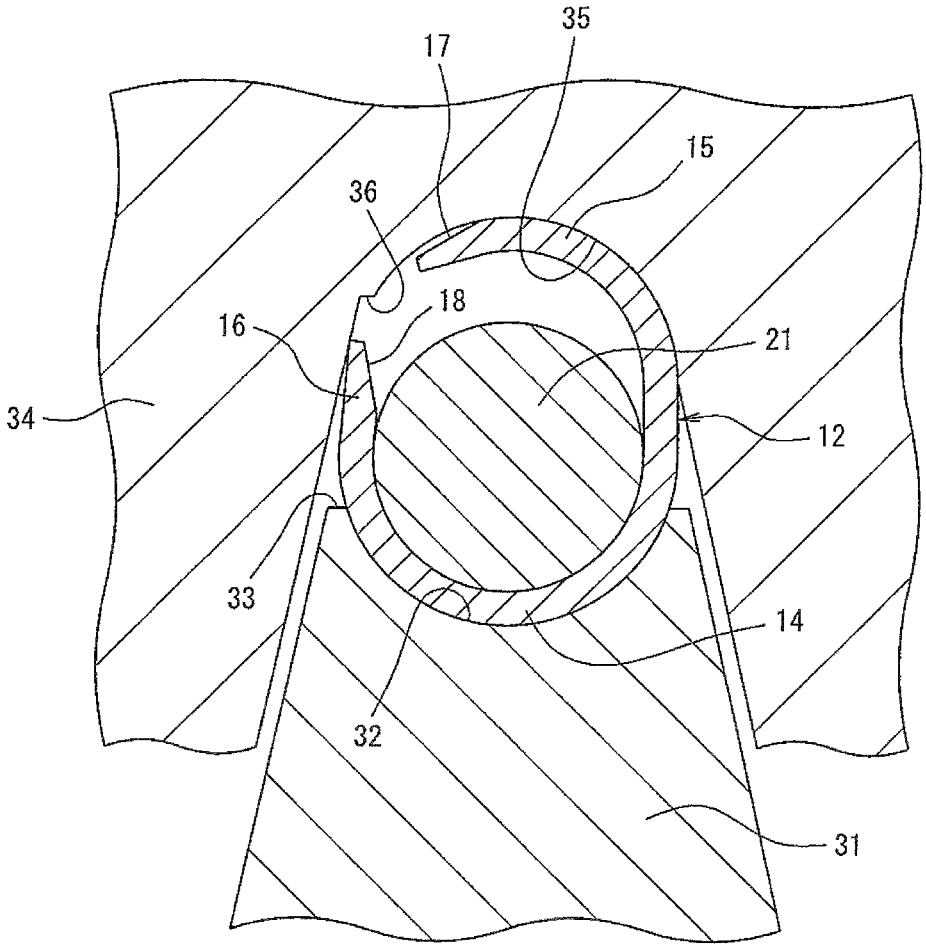
FIG. 5 is a sectional view illustrating a process for connecting the aluminum electric wire to the connector shown in FIG. 1 and FIG. 2.
Figure 6:
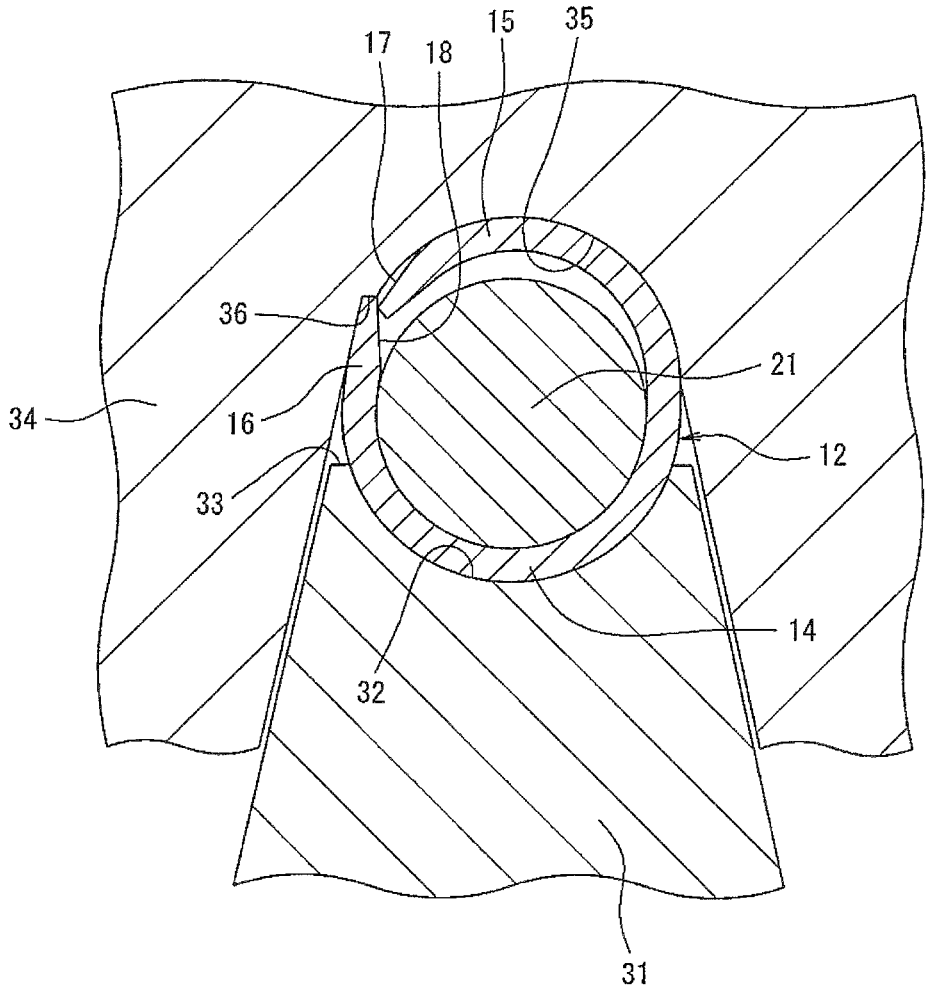
FIG. 6 is a sectional view illustrating a process for connecting the aluminum electric wire to the connector shown in FIG. 1 and FIG. 2.
Figure 7:
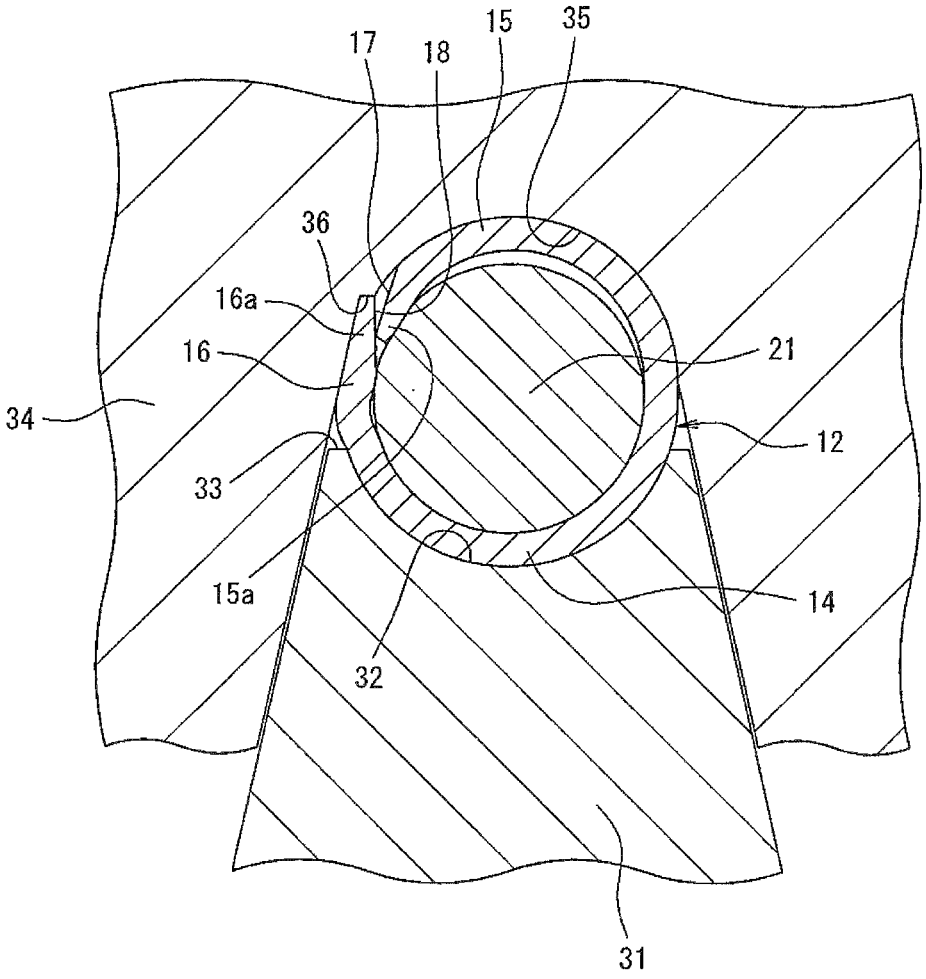
FIG. 7 is a sectional view illustrating a process for connecting the aluminum electric wire to the connector shown in FIG. 1 and FIG. 2.
Figure 8:
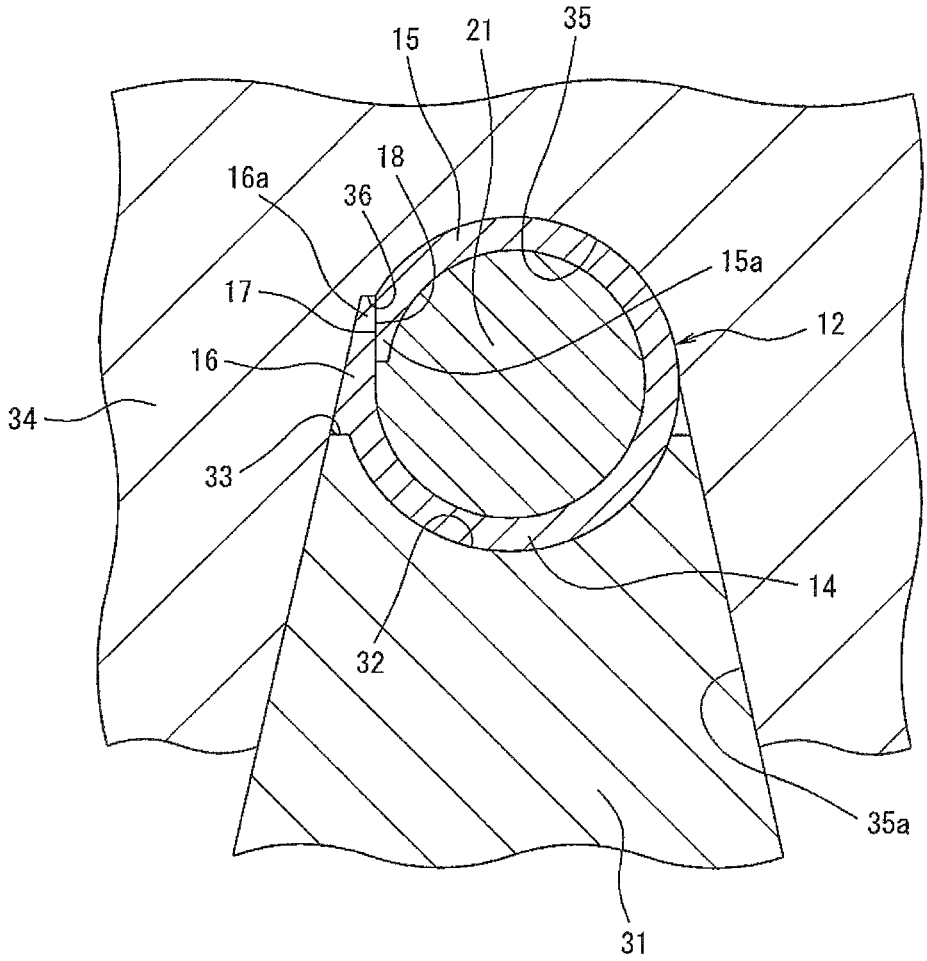
FIG. 8 is a sectional view illustrating a process for connecting the aluminum electric wire to the connector shown in FIG. 1 and FIG. 2.

Description is now made of processes of connecting an aluminum electric wire to the connector shown in FIG. 1 and FIG. 2, using FIGS. 4 to 8 (in which the projections 13 are non-depicted). First, as shown in FIG. 4, the base portion 14 of the crimping portion 12 is put in the recess 32 of the anvil 31, and a terminal portion of a solid aluminum electric wire 21 is placed in position in the crimping portion 12. Under this condition, the crimper 34 is moved downward on the paper sheet of FIG. 4, whereby as shown in FIG. 5, the first and second protruding portions 15 and 16 are elastically deformed, to bent inwardly. Then, the crimper 34 is additionally moved downward on the paper sheet of FIG. 5 whereby as shown in FIG. 6, the second protruding portion 16 has a distal end face thereof brought into contact with the pressing part 36, and the first protruding portion 15 has a distal end thereof brought into contact with the tilt face 18. Under this condition, the crimper 34 is additionally moved downward on the paper sheet of FIG. 6, whereby as shown in FIG. 7, the distal end face of the second protruding portion 16 is pushed downward by the pressing part 36, so the second protruding portion 16 is deformed downward, and concurrently deformed leftward, as well, by the receiving part 33 provided at the anvil 31. Under this condition, the crimper 34 is additionally moved downward in FIG. 7, whereby as shown in FIG. 8, the distal end part 15*a* of the first protruding portion 15 is forced to slip into depth between the aluminum electric wire 21 and the distal end part 16*a* of the second protruding portion 16, so the tilt face 17 and the tile face 18 are brought into contact with each other. On the other hand, the second protruding portion 16 is squashed to plastically deform, between the pressing part 36 and the receiving part 33. In this case, a part at the outside of the second protruding portion 16 gets in a gap defined by the crimper 34 and the anvil 31.

Figure 9:
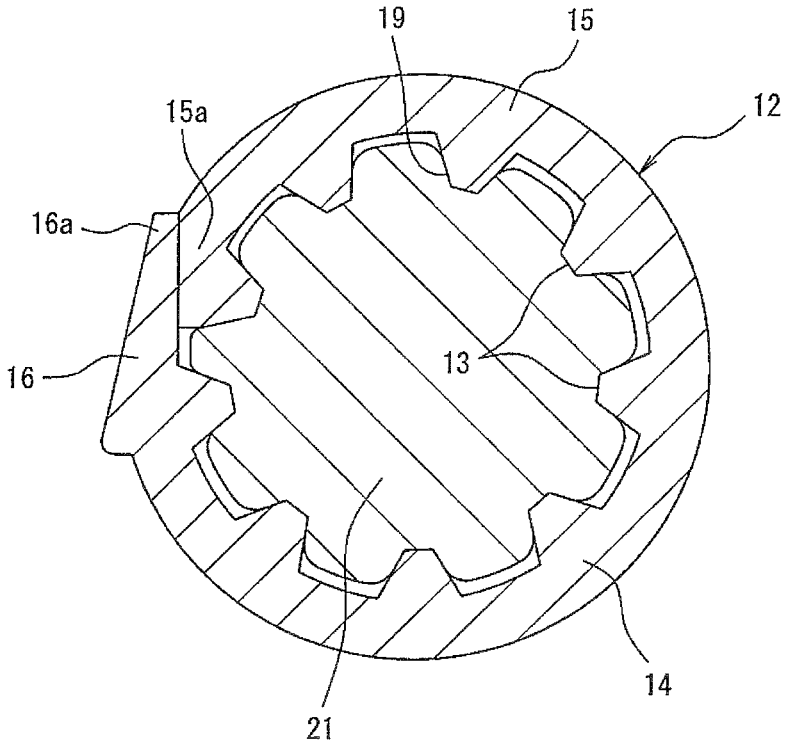
FIG. 9 is a sectional view of an aluminum electric wire connecting structure according to an embodiment of this invention.

Description is now made of an aluminum electric wire connecting structure according to an embodiment of this invention, with reference to FIG. 9. It includes a crimping portion 12 having a ring-shaped (circular) section thereof perpendicular to a length direction of an aluminum electric wire 21. Further, a first protruding portion 15 has a distal end part 15*a* thereof located at an inside of a distal end part 16*a* of a second protruding portion 16. Further, the first protruding portion 15 is elastically deformed, so the first protruding portion 15 has a spring nature. To this point, the second protruding portion 16 is plastically deformed, so the second protruding portion 16 is free from spring nature. And, projections 13 provided at the crimping portion 12 are projected into areas of surface of the aluminum electric wire 21.

Figure 17:
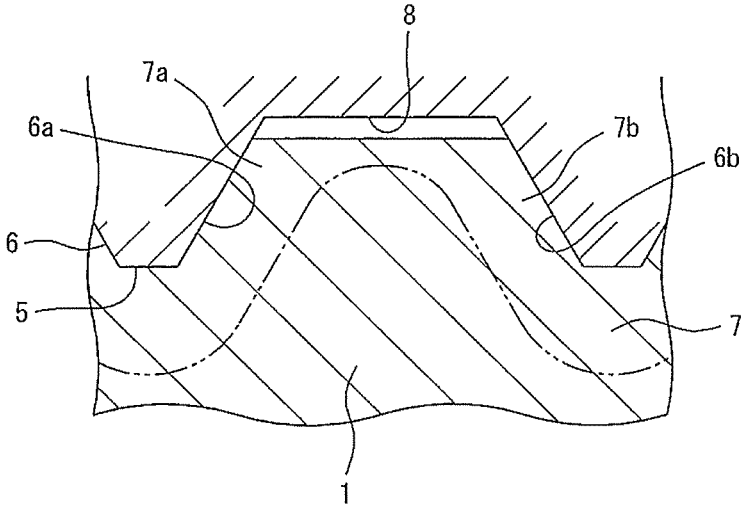
FIG. 17 Prior Art
FIG. 17 is a fragmentary detail of FIG. 16.

Also the aluminum electric wire connecting structure shown in FIG. 9 has distorted regions formed therein like the distorted regions 7 described with reference to FIG. 17. Hence, there can be cold flows developed from distorted regions along inclined sides 19, and stopped by distorted regions along opposite inclined sides 19, thus allowing for suppressed development of cold flow. It therefore is possible to suppress deteriorations of stress to be developed in distorted regions by cold flows, thus affording to suppress deteriorations of crimp forces (adhesive forces) to be developed between the aluminum electric wire 21 and inclined sides 19 of projections 13. As a result, it is possible to suppress electric resistances to be increased between the aluminum electric wire 21 and the crimping portion 12.

Further, at the aluminum electric wire connecting structure shown in FIG. 9, since the crimping portion 12 has a ring-shaped section thereof perpendicular to a length direction of the aluminum electric wire 21, the projections are allowed to have even intrusions into areas of surface of the aluminum electric wire 21, over an entire circumference of the aluminum electric wire 21. Accordingly, there can be distorted regions developed in surface regions of the aluminum electric wire 21, with even thicknesses along inclined sides 19, over an entire circumference of the aluminum electric wire 21. As a result, it is enabled to effectively suppress electric resistances to be increased between the aluminum electric wire 21 and the crimping portion 12.

Further, since the first protruding portion 15 has the distal end part 15*a* thereof located at the inside of the distal end part 16*a* of the second protruding portion 16, there can be a combination of a most distal end part of the first protruding portion 15 and a most distal end part of the second protruding portion 16, kept from being brought into a mutual pushing condition, even when the first and second protruding portions 15 and 16 expand by thermal expansion, with heat produced by current conduction or such at a connection portion between the aluminum electric wire 21 and the crimping portion 12. Therefore, those projections 13 provided at the distal end parts 15*a* and 16*a* of the first and second protruding portions 15 and 16 can be kept from having reduced intrusions into areas of surface of the aluminum electric wire 21. As a result, distorted regions along inclined sides 19 of projections 13 can have a retained state involving even thicknesses, thus allowing for a retained state to suppress deteriorations of stress to be developed in distorted regions by cold flows. It therefore is possible to have a retained state to suppress electric resistances to be increased between the aluminum electric wire 21 and the crimping portion 12.

In addition, the second protruding portion 16 is free from spring nature, while the first protruding portion 15 has a spring nature. Therefore, even when the first and second protruding portions 15 and 16 expand by thermal expansion, with heat produced by current conduction or such at a connection portion between the aluminum electric wire 21 and the crimping portion 12, the second protruding portion 16 not to be deformed toward outside does keep projections 13 from having reduced intrusions into areas of surface of the aluminum electric wire 21, allowing for a retained aluminum electric wire connecting structure, as it is shown in FIG. 9. As a result, distorted regions along inclined sides 19 of projections 13 can have an ensured retained state involving even thicknesses, thus allowing for an ensured retained state to suppress electric resistances to be increased between the aluminum electric wire 21 and the crimping portion 12.

Figure 10:
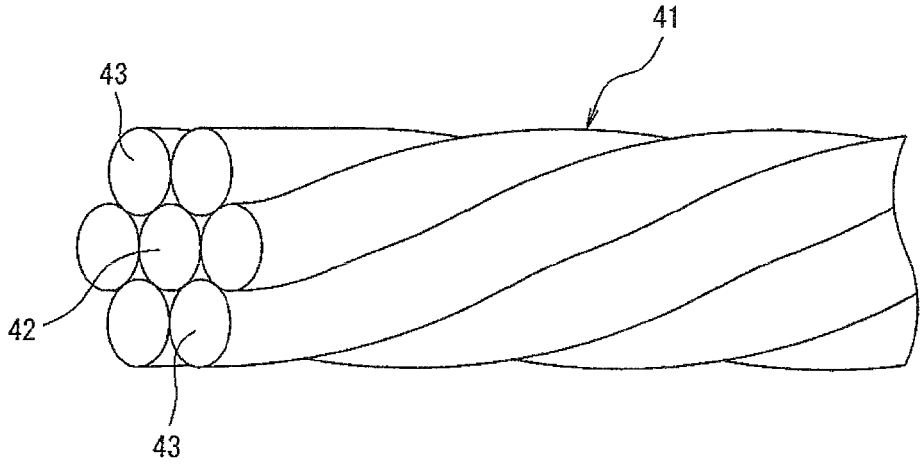
FIG. 10 is a perspective view of a terminal portion of an aluminum electric wire employed for an aluminum electric wire connecting structure according to another embodiment of this invention.

Description is now made of an aluminum electric wire 41 to be employed in an aluminum electric wire connecting structure according to another embodiment of this invention, with reference being made to FIG. 10. As shown in the figure, it includes aluminum element wires 43 spirally wound around a steel wire 42 having an aluminum film plated on a surface thereof, the aluminum element wires 43 being stranded.

This aluminum electric wire 41 is copper-free and low cost. Since the steel wire 42 having an aluminum film formed thereon is disposed at the center, the strength is great. Further, since an aluminum layer is formed on a surface of the steel wire 42 formed with the aluminum film, the steel wire 42 formed with the aluminum film is allowed to have a suppressed erosion with the aluminum element wires 43.

Figure 11:
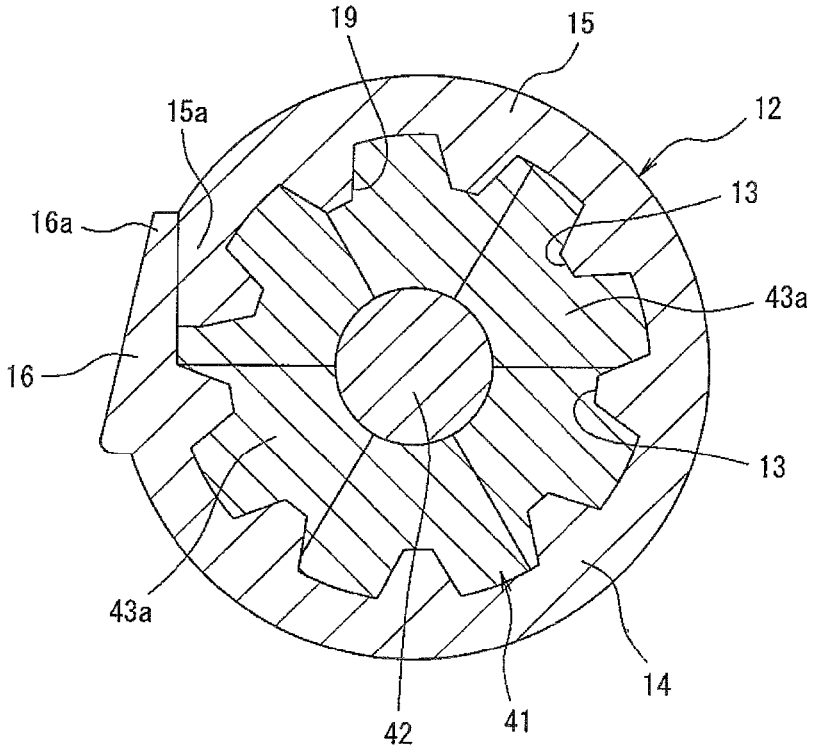
FIG. 11 is a sectional view of the aluminum electric wire connecting structure using the aluminum electric wire shown in FIG. 10.
Figure 12:
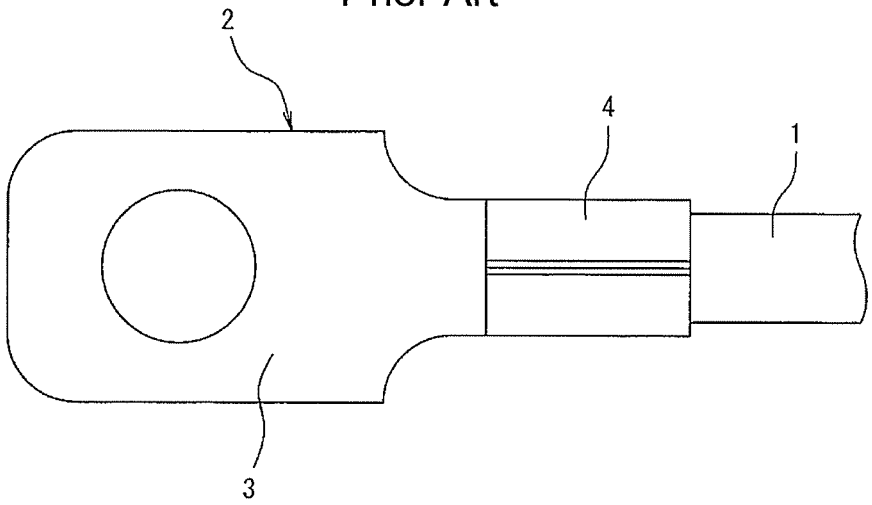
FIG. 12 Prior Art
FIG. 12 is a plan view of an aluminum electric wire connecting structure in the past.
Figure 13:
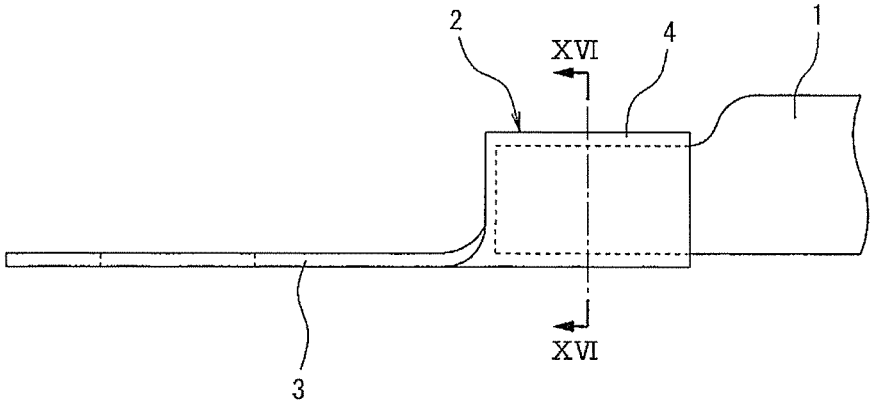
FIG. 13 Prior Art
FIG. 13 is a front view of the aluminum electric wire connecting structure shown in FIG. 12.
Figure 14:
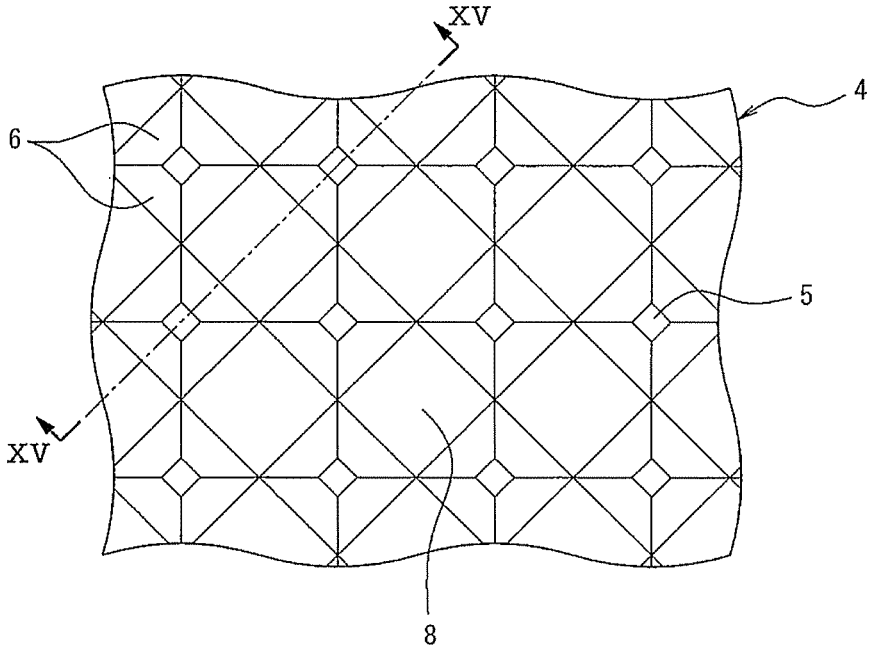
FIG. 14 Prior Art
FIG. 14 is an illustration showing part of an inner surface at a crimping portion of a connector of the aluminum electric wire connecting structure shown in FIG. 12 and FIG. 13.
Figure 16:
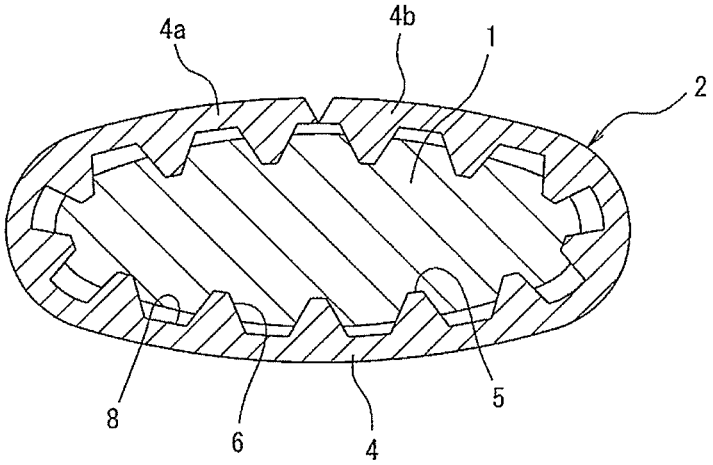
FIG. 16 Prior Art
FIG. 16 is a XVI-XVI section of FIG. 13.

Description is now made of an aluminum electric wire connecting structure according to another embodiment of this invention, with reference to FIG. 11. As shown in the figure, a crimping portion 12 has a ring-shaped section perpendicular to a length direction of a steel wire 42 formed with an aluminum film. Projections 13 provided at the crimping portion 12 are projected into areas of surfaces of deformed aluminum element wires 43*a*. Therefore, the deformed aluminum element wires 43*a* have distorted regions formed in surface regions thereof, like distorted regions 7 described with reference to FIG. 16.

At this aluminum electric wire connecting structure, since the crimping portion 12 has a ring-shaped section perpendicular to a length direction of the steel wire 42 formed with an aluminum film, there can be projections 13 projected with even intrusions into areas of surfaces of the deformed aluminum element wires 43*a*, over an entire circumference of an aluminum electric wire 41. Thus there can be distorted regions formed in surface regions of deformed aluminum element wires 43*a*, along inclined sides 19, with even thicknesses, over an entire circumference of the deformed aluminum element wires 43*a*. As a result, it is enabled to suppress electric resistances to be increased between the aluminum electric wire 41 and the crimping portion 12.

Further, like the aluminum electric wire connecting structure shown in FIG. 9, the aluminum electric wire connecting structure shown in FIG. 11 includes a first protruding portion 15 having a distal end part 15*a* thereof located at an inside of a distal end part 16*a* of a second protruding portion 16, and the second protruding portion 16 is free from spring nature, while the first protruding portion 15 has a spring nature, thus allowing for a retained aluminum electric wire connecting structure, as it is shown in FIG. 11. Accordingly, there can be a retained state involving distorted regions along inclined sides 19 of projections 13 with even thicknesses. It therefore is enabled to have a retained state to suppress electric resistances to be increased between the aluminum electric wire 41 and the crimping portion 12.

Further, since the crimping portion 12 has a ring-shaped section in a perpendicular direction to a length direction of a steel wire 42 formed with an aluminum film, there can be a crimped state involving the steel wire 42 being formed with an aluminum film and centrally located. It therefore is allowed in the crimped state to have stresses evenly acting on aluminum element wires 43. As a result, the aluminum element wires 43 are kept from getting out of arrangement, so the aluminum element wires 43 can be free from different variations in deformation. Therefore, the aluminum element wires 43 are kept from breakage when crimping.

While embodiments of this invention have been described, it is apparent that some artisan could have made changes without departing from the scope of this invention. It is intended that any and all such modifications and equivalents are involved in the appended claims.

LIST OF REFERENCE SIGNS

12 . . . crimping portion
13 . . . projection
14 . . . base portion
15 . . . first protruding portion
15*a* . . . distal end part
16 . . . second protruding portion
16*a* . . . distal end part
19 . . . inclined side
21 . . . aluminum electric wire
41 . . . aluminum electric wire
42 . . . steel wire formed with aluminum film
43 . . . aluminum element wire
43*a* . . . deformed aluminum element wire

The invention claimed is:

1. An aluminum electric wire connecting structure comprising:

a connector;

an aluminum electric wire connected to the connector;

the connector includes a crimping portion provided at an inner surface thereof with projections having inclined sides, the crimping portion includes a base portion, a first protruding portion and a second protruding portion, wherein the first protruding portion and the second protruding portion protrude from the base portion, the first protruding portion has a distal end part thereof located at an inside of a distal end part of the second protruding portion, the crimping portion has a ring-shaped section thereof perpendicular to a length direction of the aluminum electric wire, and the projections are projected into surface areas of the aluminum electric wire, with distorted regions formed, over an entire circumference of the aluminum electric wire, with the distorted regions having an even thickness in a surface part of the aluminum electric wire extending along the inclined sides of the projections of the connector.

2. The aluminum electric wire connecting structure according to claim 1, wherein the aluminum electric wire is an aluminum strand wire including aluminum element wires wound around a steel wire having an aluminum film formed on a surface thereof.

* * * * *